US008813825B2

(12) United States Patent
Evertz et al.

(10) Patent No.: US 8,813,825 B2
(45) Date of Patent: Aug. 26, 2014

(54) PERMANENT MOLD FOR CONTINUOUS CASTING

(75) Inventors: Egon Evertz, Solingen (DE); Ralf Evertz, Leichlingen (DE); Stefan Evertz, Solingen (DE)

(73) Assignee: Egon Evertz K.G. (GmbH & Co.), Solingen (DE)

( * ) Notice: Subject to any disclaimer, the term of this patent is extended or adjusted under 35 U.S.C. 154(b) by 0 days.

(21) Appl. No.: 13/375,972

(22) PCT Filed: Apr. 20, 2010

(86) PCT No.: PCT/DE2010/000441

§ 371 (c)(1), (2), (4) Date: Dec. 2, 2011

(87) PCT Pub. No.: WO2011/038704

PCT Pub. Date: Apr. 7, 2011

(65) Prior Publication Data

US 2012/0067541 A1 Mar. 22, 2012

(30) Foreign Application Priority Data

Sep. 29, 2009 (DE) ..... 20 2009 013 126 U

(51) Int. Cl.
*B22D 11/059* (2006.01)
*C25D 5/34* (2006.01)

(52) U.S. Cl.
USPC ..... 164/418; 205/115; 205/291

(58) Field of Classification Search
USPC ..... 164/418, 423; 205/115, 291
See application file for complete search history.

(56) References Cited

U.S. PATENT DOCUMENTS

| | | | | | |
|---|---|---|---|---|---|
| 3,671,407 | A | * | 6/1972 | Hamilton et al. | 205/215 |
| 4,589,468 | A | * | 5/1986 | Misera et al. | 164/418 |
| 4,949,773 | A | * | 8/1990 | Nomura et al. | 164/91 |
| 5,788,824 | A | * | 8/1998 | Catonne et al. | 205/210 |

FOREIGN PATENT DOCUMENTS

| | | | | | |
|---|---|---|---|---|---|
| DE | 30 38 289 | A1 | | 5/1982 | |
| DE | 32 11 199 | A1 | * | 9/1983 | B22D 11/059 |
| DE | 10 2005 040151 | A1 | | 3/2007 | |
| JP | 53-77840 | A | * | 7/1978 | B22D 11/04 |
| JP | 55 141364 | A | | 11/1980 | |
| JP | 56 068555 | A | | 6/1981 | |
| JP | 62-154570 | A | * | 7/1987 | H01M 4/80 |
| JP | 7 001086 | A | | 1/1995 | |
| JP | 10-305351 | A | * | 11/1998 | B22D 11/04 |

OTHER PUBLICATIONS

Machine translation of JP 10-305351 A.*

* cited by examiner

*Primary Examiner* — Kevin P Kerns
(74) *Attorney, Agent, or Firm* — McGlew and Tuttle, P.C.

(57) ABSTRACT

A copper mold or copper mold plate and also a process for reconditioning such worn molds or mold plates, which are used for the continuous casting of metals or metal alloys is provided. An electrolytically applied copper coating is provided on the inner wall of the mold or on that side of the mold plate which faces toward the casting strand.

12 Claims, No Drawings

PERMANENT MOLD FOR CONTINUOUS CASTING

CROSS REFERENCE TO RELATED APPLICATIONS

This application is a United States National Phase application of International Application PCT/DE2010/000441 and claims the benefit of priority under 35 U.S.C. §119 of German Patent Application DE 20 2009 013 126.2 filed Sep. 29, 2009, the entire contents of which are incorporated herein by reference.

FIELD OF THE INVENTION

The invention relates to a copper mold or copper mold plate for the continuous casting of metals or metal alloys, having a coating on the inner wall of the mold or on that side of the mold plate which faces toward the casting strand.

BACKGROUND OF THE INVENTION

Permanent molds of the type mentioned consist of individual plates which are assembled to form a mold. Cooling ducts, through which a cooling liquid flows, usually water, are provided in the mold plates for cooling.

It has already been described in DE 30 38 289 A1 that the inner walls of the mold are often galvanically treated in order to make the inner wall of the mold resistant to the start-up strands which move into the mold at the start of the continuous casting and later to the liquid or solidifying steel. First of all, hard chromium plating was proposed for the surface treatment, but the service lives of such molds were relatively low, and therefore a metal layer of nickel together with hard material particles suspended in a temperature-controlled solution of one or more nickel salts is proposed for deposition on the inner wall of the mold. Silicon carbide (SiC) is to be used, in particular, as the hard material particles. At that time, it was possible to surprisingly determine that nickel layers doped with SiC particles reduce wear. It was surprising that, during the casting of steel in particular, neither the liquid metal which moved into the mold chemically attacked the SiC particles nor the particles broke out mechanically during hardening of the steel.

Such an Ni coating doped with SiC particles on the inner walls of the mold was also used successfully for copper molds, which were worn so severely on the inner side by use that they were no longer usable for continuous casting. The coating on the inner wall makes it possible to restore a mold with the desired inner dimensions which ensure optimum continuous casting.

SUMMARY OF THE INVENTION

It is an object of the present invention to specify a mold or mold plate which can be produced at low cost and has an equally good wear resistance. It is a further object of the present invention to provide a process for reconditioning a copper mold or copper mold plate.

This object is achieved by a copper mold or copper mold plate for the continuous casting of metals or metal alloys. The copper mold or copper mold plate comprises a mold base body with an inner wall or a mold plate base body with a side that faces toward a casting strand being cast. A coating is provided on the inner wall of the mold or on that the side of the mold plate which faces toward the casting strand with an electrolytically applied Cu layer.

The advantage of such a mold consists in the fact that firstly copper is a less expensive raw material than nickel. Secondly, an improved adhesive bond can be achieved by coating the mold, in particular the copper mold, with copper. The wear resistance of such a mold is surprisingly better than in the case of a nickel coating. The thickness of the coating depends on the desired final dimensions of the inner dimension of the mold and is between 1 mm and 25 mm, preferably 3 mm to 15 mm. It is preferable for the applied Cu layer to have a greater hardness than the base body.

In a further embodiment of the invention, copper with silicon carbide grains is electrolytically deposited on the walls of the mold. The electrodeposition of metal layers from electrolyte solutions is known in principle from the document mentioned in the introduction. First of all, preferably a suspension of hard material particles and a wetting agent is produced, and a pasty mass thereby obtained is then added to an electrolyte solution and distributed therein. The wetting agent serves substantially to avoid agglomeration of the hard material particles in the electrolyte. As a whole, the Cu layer with embedded SiC particles improves the abrasion resistance of the inner side of the mold wall, which can also be produced so as to be sufficiently smooth in keeping with small SiC grains. The size of the SiC grains is preferably 0.3 μm to 1 μm, and the content of SiC grains by volume in the coating is at least 5% to at most 15%.

To repair worn molds or mold plates, the process according to the invention is provided, in which process material is removed mechanically from the inner surface(s) worn by continuous casting down to a maximum depth of the wear grooves, and the inner surface(s) is (are) then electrolytically coated again with copper, until the desired final dimensions are reached. This process can also be used for molds or mold plates which are produced by casting and in the case of which finally copper is electrolytically applied until the desired final dimensions are reached, if appropriate with the addition of SiC grains of the aforementioned size and quantity. In contrast to those molds or mold plates which have been produced by casting and subsequent forging, fine-grained, harder and homogeneous microstructures are obtained on the surface and lead to longer service lives.

If it appears to be useful or necessary in respect of the continuous casting process, the inner side of the mold or the inner side of the mold plate can also be provided with a nickel coating, which is applied below the later casting level height.

According to a further configuration of the invention, the applied layer is aftertreated by roller compression, preferably using a hydraulic roller compression tool. If the surface of the mold or of the mold plate still has a roughness depth of more than 100 μm, it is expedient to firstly smooth the surface by mechanically removing material until a roughness dimension of 50 μm to 70 μm, for example, is reached. For final treatment, a roller compression tool is pressed against the workpiece with a pressure of $1.5\times10^7$ Pa to $6\times10^7$ Pa, wherein the hydrostatically mounted ball of the roller compression tool brings about final strengthening of the boundary layer owing to the fact that it is guided in a meandering fashion over the surface of the mold or mold plates, in the case of which the residual compressive stress in the boundary layer is increased.

Overall, it is surprising that electrolytically applied copper layers lead to optimum results both in terms of their bonding to the base material and in terms of their structure, homogeneity, flawlessness and hardness both in the case of new, previously unused mold plates and in the case of such molds or mold plates which are already worn by continuous casting.

This applies both to pure Cu layers and to those Cu layers which are additionally provided with SiC particles.

DESCRIPTION OF PREFERRED EMBODIMENTS

In a specific exemplary embodiment, a rectangular specimen having the dimensions 25 mm×30 mm×105 mm and made of copper was electrolytically copper-plated on one side. The applied copper layer had a thickness of about 10 mm. The transition region from the base material to the layer has no misplacement or bonding defects. Whereas the Cu base material produced by casting and forging shows deformed grains with small precipitations, the Cu layer is distinguished by a very fine structure, in which individual Cu grains could no longer be induced by optical microscopy. Measurements of the hardness of the base body gave hardnesses in the range of 74 to 78 HV 0.01, whereas the hardness of the galvanically applied copper layer was 80 HV 0.01.

In a further exemplary embodiment, a rectangular specimen having the same geometry was coated with a layer of copper 10 mm thick having a content of SiC particles of a mean size of 0.5 μm of 10% by volume.

While specific embodiments of the invention have been described in detail to illustrate the application of the principles of the invention, it will be understood that the invention may be embodied otherwise without departing from such principles.

The invention claimed is:

1. A process for reconditioning a copper mold or copper mold plate for continuous casting, the process comprising the steps of:

removing material mechanically from an inner surface of the copper mold or copper mold plate that has been worn by continuous casting down to a maximum depth of wear grooves; and subsequent to said step of removing material, again coating the inner surface, wherein the coating material used is copper, which is applied electrolytically in a thickness of 1 mm to 25 mm.

2. The process as claimed in claim 1, wherein parts of the copper mold or copper mold plate are provided with an additional Ni outer layer.

3. The process as claimed in claim 2, wherein the applied layer is aftertreated by roller compression.

4. The process as claimed in claim 1, wherein the applied layer is aftertreated by roller compression.

5. A process for reconditioning a copper mold or copper mold plate for continuous casting, the process comprising the steps of:

providing one of a copper mold and a copper mold plate, said one of said copper mold and said copper mold plate comprising an inner surface, said inner surface defining wear grooves;

mechanically removing material from each portion of said inner surface of said one of said copper mold and said copper mold plate to form a smooth inner surface, wherein a thickness of said material mechanically removed from said inner surface corresponds to a maximum depth of said wear grooves; and electrolytically coating each portion of said smooth inner surface with copper after mechanically removing said material from said inner surface to form an electrolytically applied copper coating of said one of said copper mold and said copper mold plate, wherein said electrolytically applied copper coating has a thickness of 1 mm to 25 mm.

6. The process as claimed in claim 5, wherein parts of said one of said copper mold and said copper mold plate are provided with an additional Ni outer layer.

7. The process as claimed in claim 6, wherein the additional Ni outer layer is aftertreated by roller compression.

8. The process as claimed in claim 5, wherein said electrolytically applied copper coating is aftertreated by roller compression.

9. A process for reconditioning a copper mold or copper mold plate for continuous casting, the process comprising the steps of:

providing one of a copper mold and a copper mold plate, said one of said copper mold and said copper mold plate comprising an inner surface;

using said one of said copper mold and said copper mold plate in a continuous casting process, wherein said inner surface defines grooves after said one of said copper mold and said copper mold plate is used in said continuous casting process;

mechanically removing material from an entire area of said inner surface of said one of said copper mold and said copper mold plate to form a smooth inner surface, free of said grooves, after using said one of said copper mold and said copper mold plate in said continuous casting process, wherein a thickness of said material mechanically removed from said inner surface corresponds to a maximum depth of said grooves; and electrolytically coating an entire area of said smooth inner surface with copper after mechanically removing said material from said inner surface to form an electrolytically applied copper coating of said one of said copper mold and said copper mold plate, said electrolytically applied copper coating defining an outer surface of said one of said copper mold and said copper mold plate, said electrolytically applied copper coating having an electrolytically applied copper coating thickness, said electrolytically applied copper coating thickness corresponding to at least said thickness of said material mechanically removed from said inner surface, wherein said electrolytically applied copper coating thickness is 3 mm to 15 mm.

10. The process as claimed in claim 9, wherein parts of said one of said copper mold and said copper mold plate are provided with an additional Ni outer layer.

11. The process as claimed in claim 10, wherein the additional Ni outer layer is compressed via roller compression after said additional Ni outer layer is applied.

12. The process as claimed in claim 9, wherein said electrolytically applied copper coating is compressed via roller compression after said electrolytically applied copper coating is applied.

* * * * *